US005244443A

United States Patent [19]

Cerda

[11] Patent Number: 5,244,443

[45] Date of Patent: Sep. 14, 1993

[54] BABY WALKER SAFETY BARRIER

[76] Inventor: Diego Cerda, 754½ 23rd St., Richmond, Calif. 94804

[21] Appl. No.: 835,827

[22] Filed: Feb. 18, 1992

Related U.S. Application Data

[63] Continuation-in-part of Ser. No. 655,108, Feb. 14, 1991, abandoned.

[51] Int. Cl.[5] ..... A47D 13/04

[52] U.S. Cl. ..... 482/68; 280/87.051; 296/77.1; 296/35.4

[58] Field of Search ..... 482/66, 67, 68, 51, 482/77, 78, 69, 35, 36, 148; 296/97.21, 37.4, 35.4, 77.1; 280/87.051; 297/5, 6

[56] References Cited

U.S. PATENT DOCUMENTS

| | | | |
|---|---|---|---|
| 1,412,935 | 4/1922 | Greenebaum | 296/77.1 X |
| 3,193,322 | 7/1965 | Hines | 296/77.1 X |
| 3,967,833 | 7/1976 | Fleischer | 296/77.1 X |
| 4,015,853 | 4/1977 | Summers | 280/87.051 |
| 4,342,465 | 8/1982 | Stillings | 482/68 X |
| 4,389,057 | 6/1983 | Richard, Jr. | 296/77.1 X |
| 4,533,170 | 8/1985 | Banks et al. | 296/77.1 |
| 4,582,355 | 4/1986 | Hall | 296/77.1 |
| 4,678,222 | 7/1987 | Kassai | 296/77.1 |
| 4,947,883 | 8/1990 | Mayo | 280/749 X |

*Primary Examiner*—Richard J. Apley
*Assistant Examiner*—Karen A. Jalbert
*Attorney, Agent, or Firm*—James J. Leary; Douglas E. White

[57] ABSTRACT

A closed-wall barrier fits on top of a baby walker of conventional construction. It blocks a baby's reach, in order to prevent the baby from grasping dangerous objects. The barrier completely encircles the front, back and sides of the tray of the walker. The barrier may also have a top, which top may or may not be removeable. The barrier may completely cover and enclose the top of the walker. However, preferably it will have an opening or openings which the parent can use to insert the infant into the seat of the walker, and to hand objects to the infant, but which openings are too high for the infant to use to reach out.

16 Claims, 5 Drawing Sheets

FIG._1A
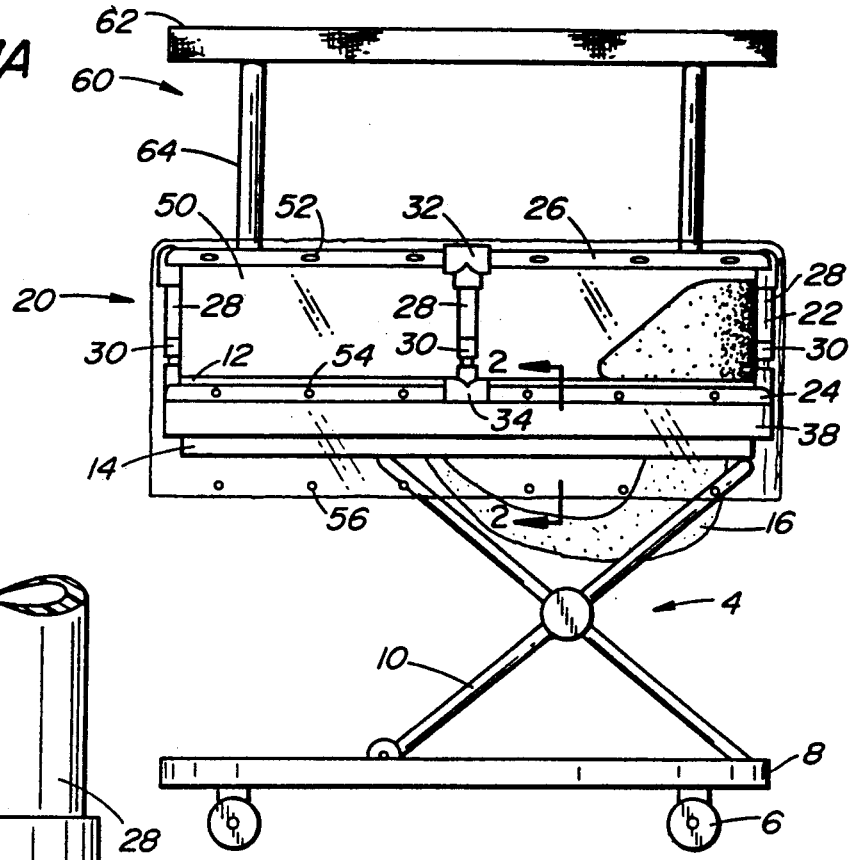
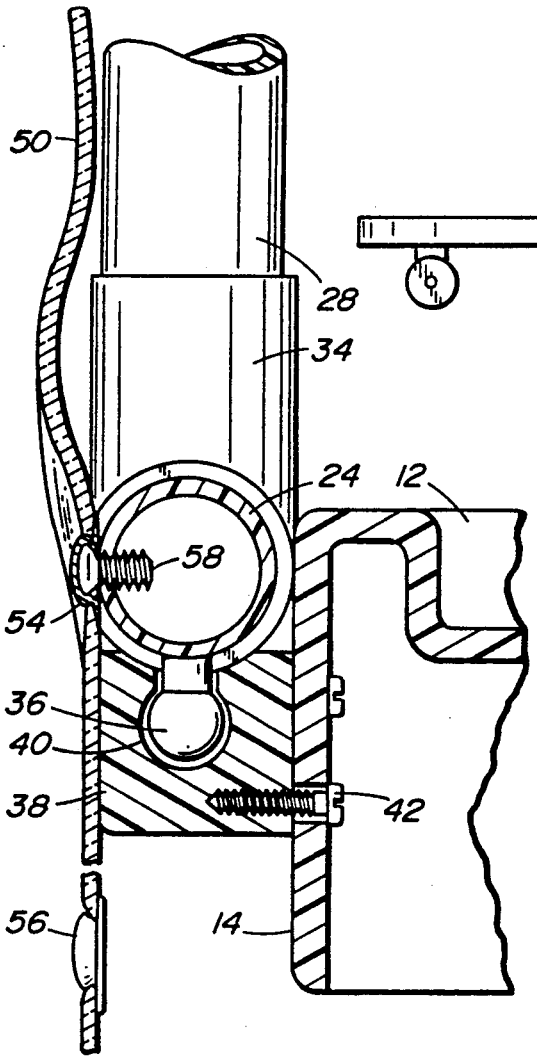
FIG._2

BABY WALKER SAFETY BARRIER

RELATED APPLICATION

This application is a continuation-in-part of applicant's application Ser. No. 07/655,108, filed Feb. 14, 1991, entitled BABY WALKER SAFETY SCREEN, and abandoned concurrently with the filing hereof.

FIELD OF THE INVENTION

This invention relates to children's mobile push carts, commonly known as baby walkers, and more particularly to a safety barrier for such a walker which prevents a child from using the walker to reach dangerous objects.

BACKGROUND OF THE INVENTION

Wheeled baby walkers assist a baby who is unable to walk or crawl to become mobile sooner than otherwise is possible. However, when using presently available walkers, the infant often becomes able to stand and reach dangerous objects which otherwise would be safely out of reach of a crawling infant. This creates new opportunities for choking or poisoning accidents, which accidents all parents are naturally extremely anxious to prevent.

Prior developments in this field may be generally illustrated by reference to the following patents:

| Patent No. | Patentee | Issue Date |
|---|---|---|
| 196,730 | J. Wick | Oct. 30, 1877 |
| 162,153 | I. Clark | Apr. 21, 1875 |
| 658,126 | D. Settlemyre | Sep. 18, 1900 |
| 1,576,501 | V. Bibo | Mar. 16, 1926 |
| 3,874,690 | B. Marrone | Apr. 01, 1975 |
| 1,139,762 | A. Hellfritzsch | May 18, 1915 |
| 71,397 | C. Loring et al. | Nov. 26, 1867 |
| 1,298,053 | H. Kennedy | Mar. 25, 1919 |
| 2,244,096 | J. Brazell | Jun. 03, 1941 |

U.S. Pat. Nos. 196,730 and 162,153 teach baby walkers with open-wall perimeter rings. Such rings do not provide the type of protection afforded by the closed-wall barriers herein proposed.

U.S. Pat. No. 1,576,501 shows a clam-shell hood for a baby carriage which is used as a storm cover. While this may incidentally prevent a baby from reaching outward, the carriage is not a device which the baby can move by itself to dangerous areas.

The rest of these patents are representative of what is in the art.

SUMMARY OF THE INVENTION

The present invention is a screened (closed-wall) barrier which fits on top of the walker and blocks the infant's reach, in order to prevent him or her from grasping dangerous objects. It completely encircles the front, back and side of the top tray of the walker. The barrier may also have a closed-roof top, which top may or may not be removeable. The barrier may even completely cover and enclose all of the top of the walker. However, preferably it will have openings which the parent can use to hand objects to the infant, but which are too high up the sides for the infant to use to reach out.

The barrier may be built into the walker. However, preferably it is removable by means of suitable snaps, clamps, latches, hooks or the like.

The barrier may be adjustable in height. It may comprise either mesh fabric screen sides or clear plastic film screen sides, neither of which obstructs the infant's view. Nor does either significantly obstruct a parent's view of the infant from the outside. A suitable frame supports the mesh or plastic screen.

FEATURES AND ADVANTAGES

An object of this invention is to provide a baby walker safety apparatus which includes a baby walker having a top play tray lying in a horizontal plane, the top tray having an encircling perimeter. The invention comprises a closed-wall barrier affixed to the perimeter of the top tray, the closed-wall barrier having a height above the horizontal plane of the top tray of at least five or six inches.

A further object is to disclose an upper limit on the height of the closed-wall barrier of twelve to fifteen inches.

Yet another object is to provide a transparent screen as part of the closed-wall barrier.

Preferably, the transparent screen provided is imperforate clear plastic film, although it may alternatively be mesh fabric.

A further feature or object is a flange affixed to the perimeter of the top tray and means for affixing the closed-wall barrier to the flange. The affixing means is a plurality of post-and-ball bottom-rail snaps on the closed-wall barrier and a corresponding plurality of sockets on the flange for the post-and-ball snaps.

Yet another object or advantage of the invention is a frame in the barrier and, for affixing the screen to the frame of the barrier, either hook-and-loop fastener material or a plurality of screen snaps.

Still another feature is a top removably attached to the frame of the barrier.

An additional feature is the provision of two or more sets of removable posts of different lengths, for adjusting the height of the barrier.

Another object is to provide an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made. The words "inwardly" and "outwardly" will refer to directions toward and away from, respectively, the geometric center of a device and designated parts thereof.

BRIEF DESCRIPTION OF THE DRAWING

FIG. 2 is an enlarged sectional elevation of the perimeter flange area of the device, taken along line 2—2 of FIG. 1A;

Drawing Reference Numerals

Figure 1:
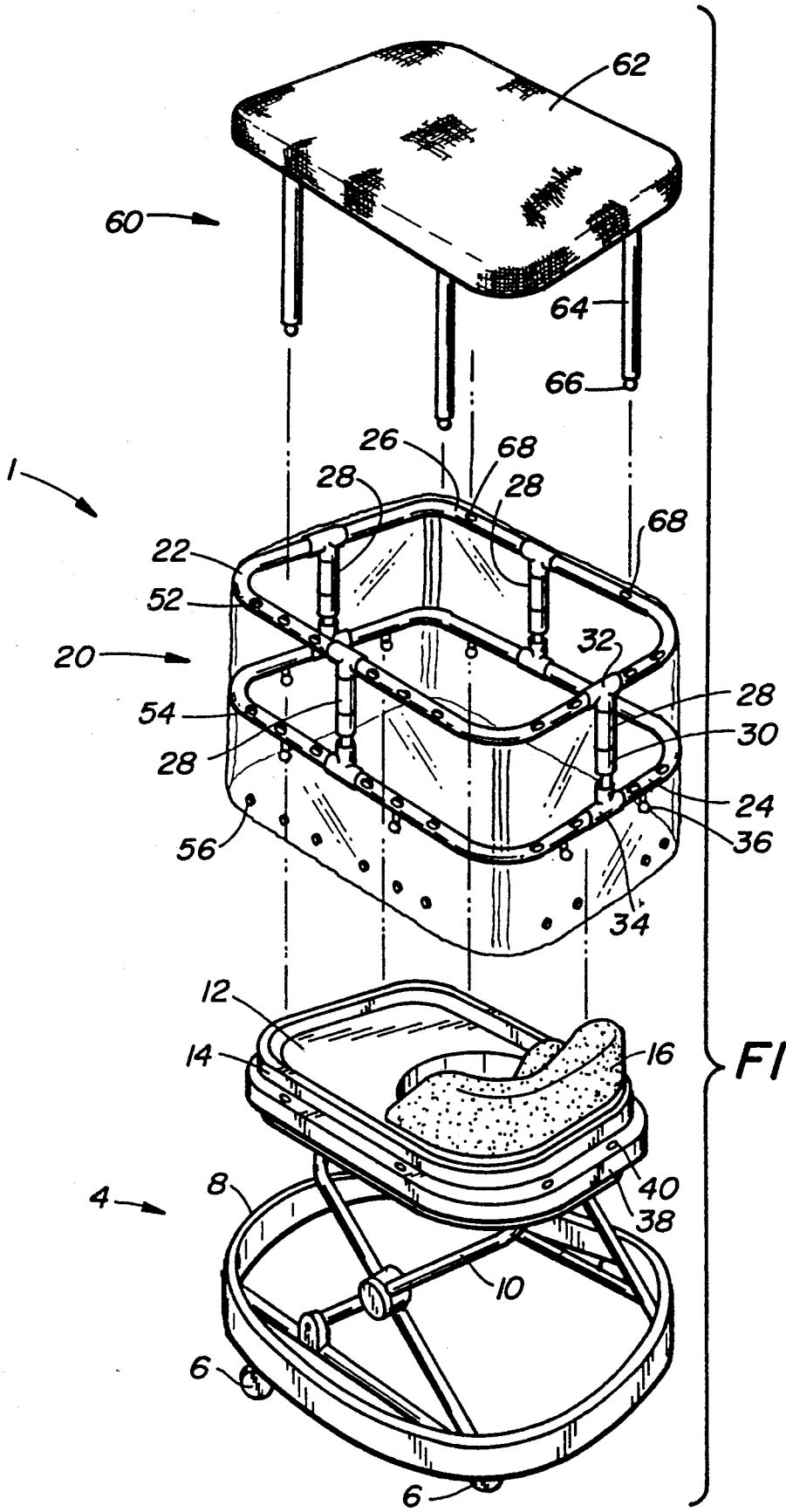
FIG. 1 is an exploded perspective view of the baby walker safety apparatus of this invention, FIG. 1A being a side elevation thereof.

1 baby walker apparatus
4 walker
6 wheel of 4
8 base rim of 4
10 frame of 4
12 tray of 4
14 perimeter wall of 12
16 seat of 4
20 barrier
22 frame of 20
24 lower rail of 22
26 upper rail of 22
28 post of 22
30 extension grip of 28
32 upper bracket for 28
34 lower bracket for 28
36 post and ball snap of 24
38 perimeter flange for 20
40 socket in 38 for 36
42 screw of 38
50 screen of 20
52 snap for 26
54 snap for 24
56 snap for 24
58 screw for 54, 56
60 top
62 screen of 60
64 post of 60
66 ball snap of 64
68 socket in 26 for 66
101 baby walker apparatus
104 walker
120 barrier
122 frame of 120
123 hoop of 122
125 pivot of 123
150 screen of 120
154 snap
201 baby walker apparatus
204 walker
206 wheel of 204
208 base rim of 204
210 frame of 204
212 tray of 204
214 perimeter wall of 212
216 seat of 204
220 barrier
222 frame of 220
224 lower rail of 222
226 upper rail of 222
228 post of 222
229 post of 222
232 socket for 228 or 234
234 pin for 228
235 socket for 234
244 hook of 224
246 plate of 224
248 inside perimeter wall of 224
250 film screen of 220
252 hook material on 226
253 loop material on 250
254 hook material on 224
255 loop material on 250

Description of a Preferred Embodiment

Referring to FIGS. 1 and 1A, there is illustrated therein a first baby walker safety apparatus 1 of this invention. Apparatus 1 generally comprises a walker 4, a safety barrier 20 and an optional removeable top 60.

Walker 4 is preferably of existing conventional construction. The safety barrier 20 is designed for retrofitting onto a variety of walkers currently being marketed, in addition to being incorporated into a walker at the point and time of manufacture. The walker 4 has a set of wheels or rollers 6 mounted on a base rim 8. An adjustable-height frame 10 supports a horizontal top play-tray 12. The horizontal plane of the play-tray intersects a baby of average height at about the mid-chest level when the baby is seated in the walker. The tray will typically have an encircling perimeter wall 14 that projects upwardly 1 or 2 inches above the horizontal plane of the tray. The wall serves to hold objects in the tray and to act, along with the base rim 8, as a form of "bumper." In addition to providing a play surface, the top tray 12 is used to contain and support a baby's seat 16. This much is standard.

The safety barrier 20, which is the heart of this invention, will normally have its own frame 22, which frame is tubular in this embodiment. The frame 22 is comprised of a lower-rail loop 24 spaced downwardly from an upper-rail loop 26 by a series of four or more telescoping posts 28. The lower-rail loop 24 is designed to encircle the perimeter 14 of the walker tray 12, leaving clear the tray itself. The loop of the upper rail 26 forms an opening which is just as large as the walker tray. Therefore, with the barrier 20 in place a baby still may easily be lifted in and out of the walker 4 by an adult, and toys may be added to and removed from its tray 12. Even were the upper rail 26 to form a smaller opening leading just to the seat 16 (ready access by an adult to the play-tray area perhaps not being mandatory), the top opening should never be smaller than what would be necessary in an emergency to remove the baby immediately, without having to disconnect the barrier, for obvious reasons of safety.

The tubes of the frame may be made of suitable semi-rigid plastic, such as ABS or polystyrene. However, the tubes may be made of a softer plastic or may otherwise be shaped or cushioned (particularly in the case of the upper rail 26) so as to protect the baby from injury should the baby bump into the frame. Welded metal bars or beams could also be substituted for plastic tubes.

The height of each support post 28 may be adjusted by turning an extension grip 30, which grip alternately engages and releases an internal telescoping member, in standard fashion. This allows the height of the barrier 20 to be increased as the baby grows taller and enlarges his or her reach. The posts 28 may be connected to the upper and lower rails 26, 24 through pipe brackets 32 and 34, respectively. Alternatively, the posts may be glued, heat welded or molded in place.

As another alternative, the screen of the barrier 20 may be fabricated so as to provide structural support on its own, in order that the side posts, and, perhaps, even the upper and lower rails, could be eliminated. For example, the screen could be molded out of a rigid or semi-rigid plastic, with small apertures being left to allow visibility (in the manner of, for example, common plastic clothes baskets). As long as the apertures were too small for a baby to reach its hand through, such apparatus would still qualify as a "closed-wall" system.

An encircling perimeter flange 38 is secured to the perimeter wall 14 of the walker tray 12. This flange 38 is one way of supporting the removeable barrier assembly 20. A plurality of post-and-ball snaps 36 (preferably two to a side) depend downwardly from the bottom of the lower frame rail 24 of the barrier. As best seen in FIG. 2, the snaps 36 mate with congruently shaped sockets 40 that are located in the upper surface of the flange 38 at positions corresponding to those of the snaps. The flange may be secured to the walker perimeter by screws 42, or it may be glued or molded in place. It will preferably have a slightly concave dimple in its upper surface into which the cylindrical surface of the lower rail 24 may rest. There should be little or no clearance between the rail 24 and the tray perimeter wall 14, so that the baby will not be able to get its fingers stuck between them.

Alternatively, each side's pair of post-and-ball snaps could be extended together to form a single elongate snap. In other words, the posts could be connected horizontally to form a continuous flat web and the balls could be drawn together to form a cylinder, the combination of which would fit in a long groove in the flange 38. This elongate snap, and its associated groove, would each be perhaps 4 inches in length. As another alternative, the surrounding perimeter flange could be broken into a plurality of small brackets, with one bracket for each snap 36.

The barrier frame 22 supports a transparent screen 50. The screen may be affixed to the upper rail 26 by such means as a row of button snaps 52, from where it drapes downward. It could perhaps hang loose, provided its fit on the frame is snug. However, to prevent the baby from lifting the screen 50 up to get at dangerous objects, it should preferably be affixed to the lower rail 24 as well. A second row of button snaps 54 serves this purpose. A portion of the screen 50 should fall below the line of the lower rail so as to be available when the height of the barrier 20 is adjusted upwardly. A third row of button snaps 56 is available in reserve. There also could be additional rows reserved for this purpose. Rows 52 and 54, 56 snap to the heads of screws 58 lodged in the rails 26 and 24, respectively.

Alternatively, the snaps could be replaced with hook-and-loop fastener material, such as that commonly sold under the trademark VELCRO, as will be discussed below in connection with the embodiment of FIG. 4. Furthermore, the screen 50 could be permanently attached by glue, welds, rivets or the like. However, such a non-removeable barrier probably would be practical only in embodiments whose height is not adjustable.

The barrier may include, as an option, a removeable top 60. The top may be covered by a transparent screen 62. While the side screen 50 is illustrated as being made of transparent plastic and the top screen 62 is shown as a fine mesh, either type of material may be used for either screen. It is particularly important, however, that the side screen be largely transparent in order that the baby may see where he or she is pushing the walker and the parent may see what the baby is doing.

The top 60 may be attached to the upper rail 26 of the barrier frame by means of four or more posts 64. The posts may be tipped with ball or prong snaps 66 that mate with sockets 68 (FIG. 1) in the upper rail 26, or may include other means for removably securing the top to the barrier frame 20.

While a further barrier wall could be added around the top posts 64 to completely enclose the baby within the walker, it will no doubt be best to leave wide openings between the top posts, as illustrated, in order that the baby and its parent may pass objects freely between them. One benefit of a top 60 could be to prevent the child from standing up to try to lean over the barrier 20. It also prevents the baby from positioning the walker under a table and reaching straight up for objects.

Note that the barrier frame 22 is sufficiently high that the baby's arm's will not extend far enough to allow it to reach out through the openings between the top posts 64. With or without a top, the height of the barrier frame 22 (and the wall or screen 50) is preferably seven or eight inches, although the height may be telescoped from about six to about twelve inches. Five and fifteen inches are likely to be the lower and upper limits of effectiveness, respectively. These height limits distinguish the wall or screen 50 from the two-inch tray perimeter wall 14 that is used to keep objects on the tray, but which does not impede a baby's reach.

The seat 16 is typically constructed so as to render it difficult or impossible for the baby to reach behind it. However, if that is a problem on a particular model of walker, the space between the rear top posts 64 can be screened in, while the front and side spaces remain open.

Figure 3:
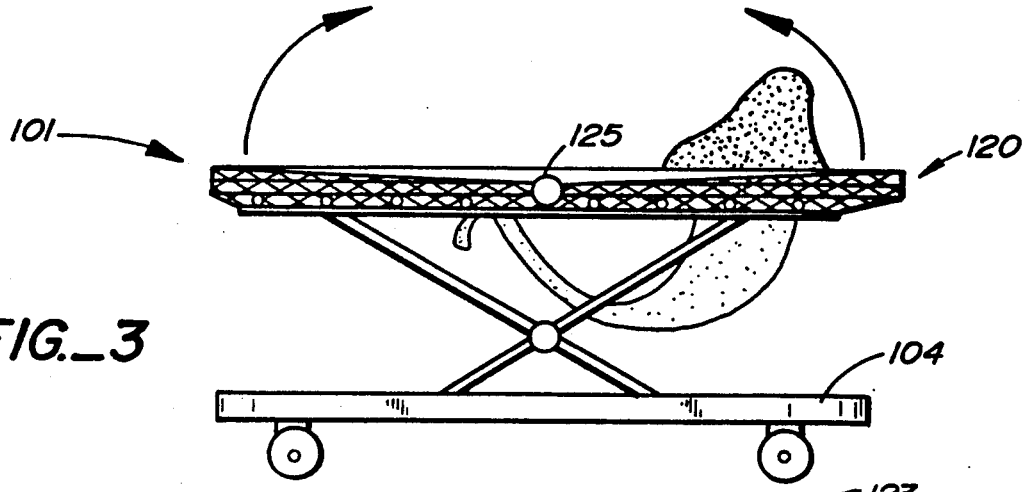
FIG. 3 is a side elevation of an alternate embodiment of the invention, FIGS. 3A and 3B showing the barrier in consecutive alternate positions.
Figure 3A:
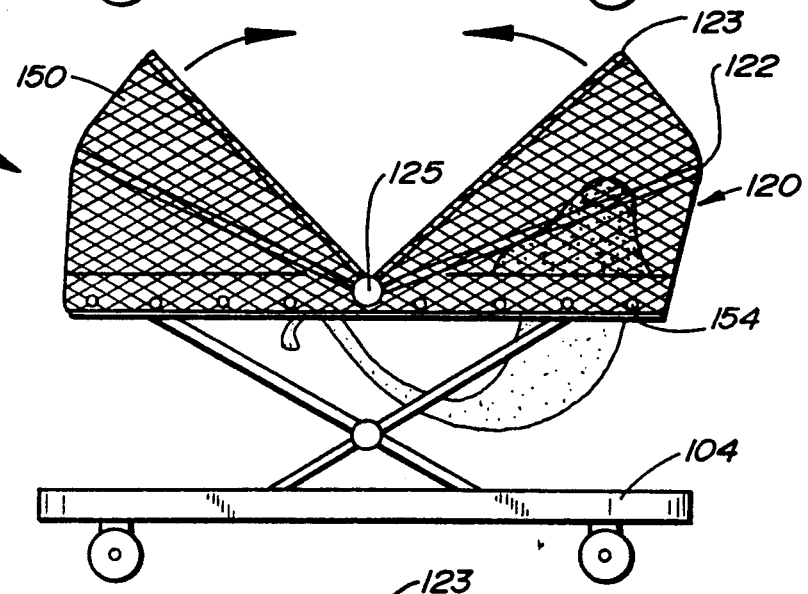
Figure 3B:
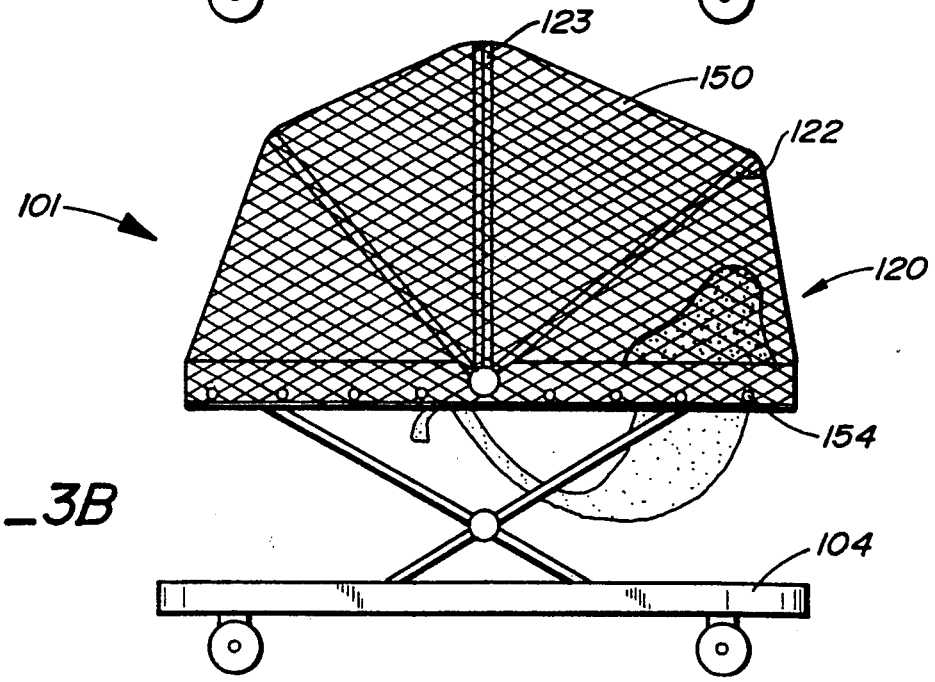

FIGS. 3, 3A and 3B illustrate an alternate embodiment of the invention. The baby walker safety apparatus 101 comprises a "clam shell" barrier 120 which affixes to a walker 104 of conventional design by means of snaps 154 or other suitable means. An internal frame 122 is comprised of a plurality of tubular hoops 123, which hoops pivot about a pivot hinge 125. The frame supports a barrier screen 150 made of fine mesh or transparent plastic. The screen opens and closes as shown in the consecutive series of figures.

While the safety apparatus 101 does prevent a baby from reaching out beyond the perimeter of the walker 104, it does not readily allow objects to be passed between parent and child. Furthermore, babies may find it confining. Therefore, it could not be said to be equivalent to the previous embodiment, and the previous embodiment is preferred over it.

Figure 4:
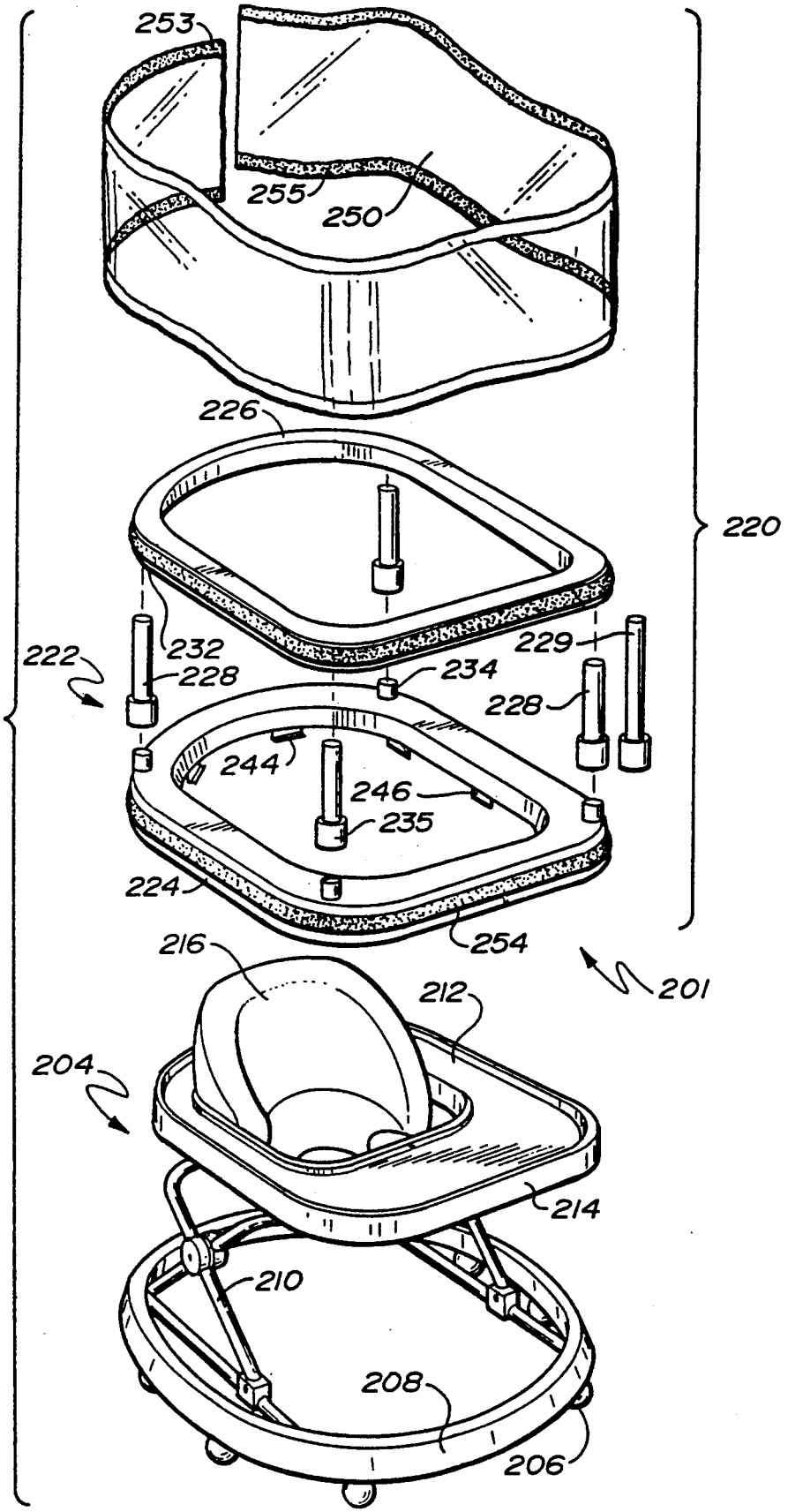
FIG. 4 is an exploded perspective view of another alternate baby walker safety apparatus, FIG. 4A being an enlarged sectional elevational detail of a post area of the barrier and FIG. 4B being a detail of the same area in a second position.
Figure 4A:
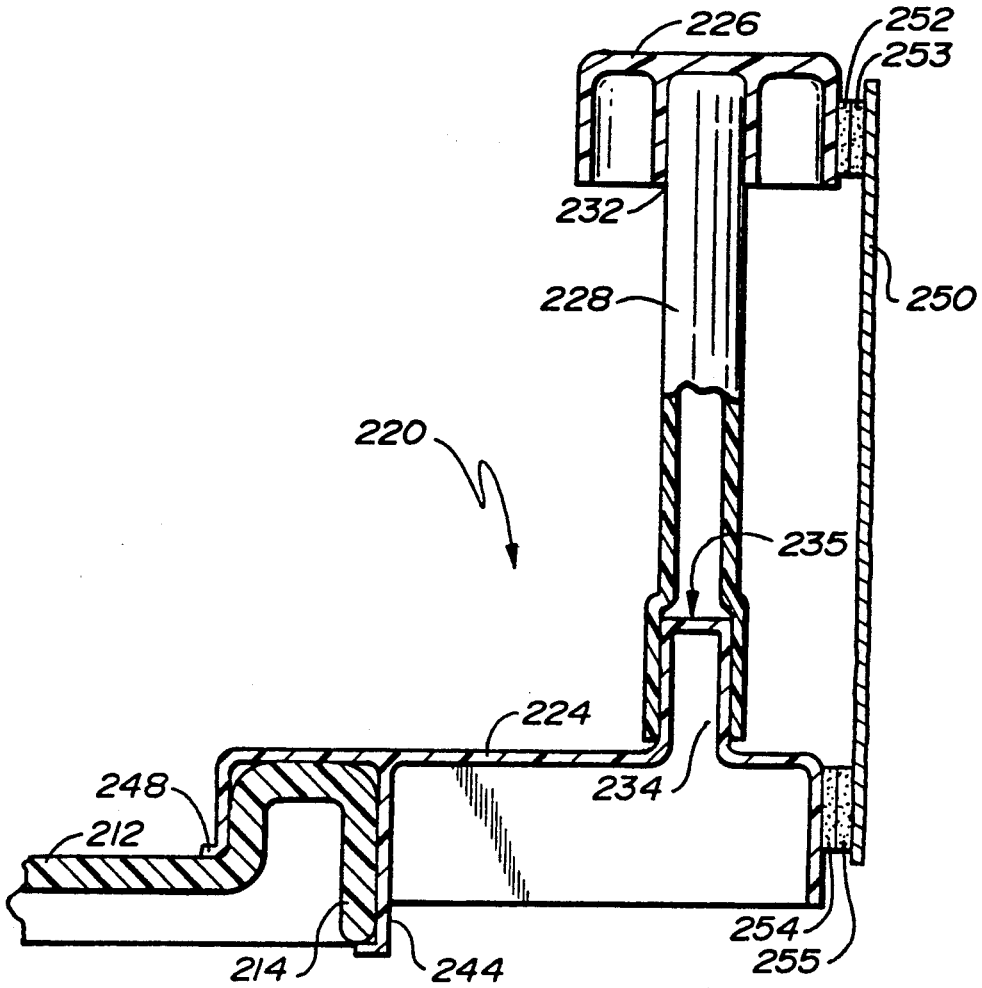
Figure 4B:
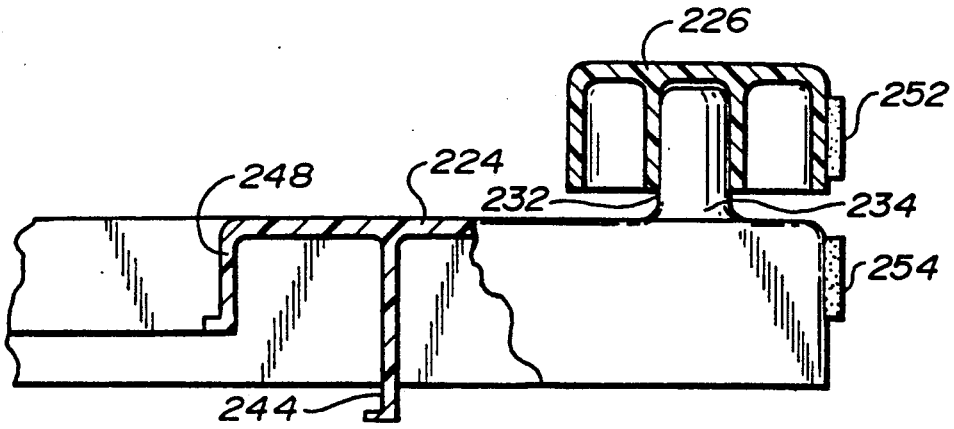

Referring to FIGS. 4, 4A and 4B, there is illustrated therein another alternate embodiment of the invention; namely, baby walker safety apparatus 201. Currently, this embodiment is preferred.

Apparatus 201 generally comprises a walker 204 and a safety barrier 220. Walker 204 is also preferably of existing conventional construction, onto which the safety barrier 220 is designed for retrofitting without any modification thereof and without the need for screws, glue or the like.

The walker 204 has a set of wheels or rollers 206 mounted on a base rim 208. An adjustable-height frame 210 supports a horizontal top play-tray 212. The tray will typically have an encircling perimeter wall 214 that projects upwardly above the horizontal plane of the tray. In addition to providing a play surface, the top tray 212 is used to contain and support a baby's seat 216. As in the embodiment of FIG. 1, this much is standard.

The safety barrier 220 has its own frame 222, which frame is principally formed of molded hollow-channel stock in this embodiment. The frame 222 is comprised of a lower-rail loop 224 that is spaced downwardly from an upper-rail loop 226 by means of a series of four or more posts 228. The frame may be made of suitable semi-rigid plastic, such as ABS or polystyrene. However, the rails may be made of a softer plastic or may otherwise be shaped or cushioned (particularly in the case of the upper rail 226) so as to protect the baby from injury.

The barrier frame 222 supports a transparent screen 250 formed of plastic film. The film screen 250 is preferably imperforate, so as to provide protection outdoors from the wind. Indoors, the absence of holes improves the infant's visibility and it may even offer some protection against collisions with sharp objects.

The screen is preferably affixed to the upper rail 226 by VELCRO-type hook-and-loop fastener material. One type of material, for example, loop material 253, is glued or otherwise mounted on the upper edge of the screen 250. Loop material 253 removably mates with correspondingly matched hook material 252, the latter of which is mounted on rail 226. Hook material 254 is mounted on the lower rail 224 as well. This material mates with a second strip of loop material 255 on the lower edge of the screen 250. Obviously, however, which material (hook or loop) is placed on the frame 222 and which opposite material is placed on the screen 250 is unimportant.

Telescoping posts could be used to adjust the height of the barrier 220, or even a collapsible scissors-lift (similar to the scissor frame 210 of the walker 204). However, preferably, the set of posts 228 will be of fixed length, but removable, so that a second set of posts of greater length, such as post 229, could be substituted therefor. A taller screen (not illustrated) could be substituted for the screen 250 when the short posts 228 are replaced with the long posts 229. Alternatively, an additional row or rows of VELCRO (or a single wide strip) could be added to the lower edge of the screen 250, in the manner of the multiple rows of snaps of the embodiment of FIG. 1.

Turning to FIGS. 4A and 4B, it can be seen that each post 228 (or 229) fits in a cylindrical socket 232 which depends downwardly from the hollow-channel interior of the upper rail 226. Projecting upwardly from the top surface of the lower rail 224 are a series of pins 234, the diameter of which preferably matches the common diameter of the top of the posts 228, 229. The pins mate with sockets 235 formed in the bottoms of the posts 228, 229. Thus, the posts 228 (or an equal number of posts 229) may be used to support the upper rail 226 at a fixed distance above the lower rail 224, which distance may be altered merely by choosing posts of the proper height.

The previous embodiments required a separate piece to be more or less permanently screwed onto the walker tray (such as perimeter flange 38 of FIG. 2) in order to support the removable barrier. The walker apparatus 201, however, incorporates a barrier frame 222 which merely snaps in place on the tray 212—thus eliminating the need for such an attachment flange.

As can be seen in FIGS. 4 and 4A, a plurality of hooks 244 depend downwardly from the hollow-channel interior of the lower rail 224. These flexible hooks snap onto and securely grasp the lower outer edge of the perimeter wall 214 of the walker tray 212. The inside perimeter wall 248 of the lower rail 224 simultaneously contacts the bead formed along the interior perimeter of the upper surface of the tray 212. This biases the tray perimeter 214 against the hooks 244.

While a large number of hooks 244 could be used in this manner to secure the frame 210 to the walker 204, it might become difficult for a single individual to manipulate them for the removal of the barrier 220. Therefore, it will be preferable to limit the numbers of hooks 244 and to provide a number of downwardly depending flat (i.e. unhooked) plates 246 spaced among the hooks, for providing the biasing function at intervals wherein there are no hooks 244 (see FIG. 4).

When it is desired to transport the walker apparatus 201, the posts 228 or 229 may be removed entirely and separately stored, along with the plastic film screen 250. The upper rail 226 may then be brought down so that the pins 234 engage in the sockets 232, as can been seen in FIG. 4B. This allows the rails to be stored or transported conveniently mated together. Alternatively, when the barrier 220 is so collapsed and mated, the frame 210 of the walker 204 also may be collapsed, and the entire walker and frame 222 stored or transported as one piece, while presenting a minimal height overall.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, capacities, sizes, operational features or the like. As just one example, each support post could be made to telescope by means of a removable pin which is inserted through sequentially matched pairs of aligned apertures. Therefore, the above description and illustrations should not be construed as limiting the scope of the invention which is defined by the appended claims.

What is claimed is:

1. Safety barrier apparatus for a baby walker of the type having a top tray lying in a horizontal plane, the top tray having an encircling perimeter, the safety barrier including:

a vertical closed-wall screen mounted on a frame, the frame having an upper rail forming a first closed loop the first loop defining an opening of size sufficient through which to pass a human infant, a lower rail forming a second closed loop, and a plurality of telescoping vertical post members separating the upper and lower rails; and an attachment means for removably affixing the frame to the perimeter of the baby walker.

2. The apparatus of claim 1 further including:

means for mounting the screen to the upper rail; and at least one row of snaps on the screen for mounting the screen to the lower rail.

3. The apparatus of claim 2 wherein:

there are at least two rows of snaps for mounting the screen to the lower rail.

4. The apparatus of claim 3 wherein:

the screen has a vertical height of at least five inches.

5. The apparatus of claim 4 wherein:

the screen is transparent.

6. The apparatus of claim 1 wherein said attachment means comprises:

a flange encircling the top tray perimeter of said baby walker, means for attaching said flange to said top tray, said flange including means for grasping the lower rail of the frame.

7. The apparatus of claim 6 further including:

a closed-roof top attached to the frame.

8. The apparatus of claim 7 further including:

post-and-ball snaps on the lower rail of the frame for engaging with the grasping means of the flange.

9. Safety barrier apparatus for a baby walker of the type having a top tray lying in a horizontal plane, the top tray having an encircling perimeter, the safety barrier including:

a vertical closed-wall screen mounted on a frame, the frame having an upper rail forming a first loop, the first loop defining an opening of size sufficient through which to pass a human infant, a lower rail forming a second loop, and a plurality of vertical posts separating the upper and lower rails; and means for removably affixing the frame to the perimeter of the baby walker.

10. The apparatus of claim 9 further including:

hook-and-loop fastener material on the screen and on the upper and lower rails, whereby the screen may be removably mounted to the rails.

11. The apparatus of claim 9 wherein:

the screen is formed of transparent and imperforate plastic film.

12. The apparatus of claim 11 wherein:

the means for removably affixing the frame to the perimeter of the baby walker includes at least one hook depending downwardly from the the lower rail.

13. The apparatus of claim 9 wherein:

the posts may be removed from the rails, and the plurality of posts includes at least two sets of posts, the length of the posts within each set being equal, but the length of the posts within any one set being different from the length of the posts of the other set or sets.

14. Baby walker safety apparatus including:

a baby walker having a top play-tray lying in a horizontal plane, the play-tray having an encircling perimeter; and a vertical closed-wall screen of imperforate transparent plastic film mounted on a frame, the frame having an upper rail forming a first loop, the first loop defining an opening of size sufficient through which to pass a human infant, and means for elevating the upper rail above the plane of the tray at least five inches.

15. The apparatus of claim 14 further including:

a lower rail of the frame forming a second loop, the lower rail being removably affixable to the perimeter of the play-tray.

16. The apparatus of claim 15 wherein:

the elevating means is a plurality of vertical posts separating the upper and lower rails, the posts having first sockets at one of the two ends of each thereof, into each of which first sockets is insertable a pin of a plurality of pins projecting from one of the two rails, the other ends of the posts being insertable into second sockets in the other of the rails.

* * * * *